US006314253B1

(12) United States Patent
Hosoya et al.

(10) Patent No.: US 6,314,253 B1
(45) Date of Patent: Nov. 6, 2001

(54) IMAGE FORMING APPARATUS AND IMAGE FORMING METHOD

(75) Inventors: Masahiro Hosoya, Okegawa; Hitoshi Yagi, Yokohama; Takeshi Watanabe, Ichikawa; Yasushi Shinjo, Kawasaki; Haruhi Oh-oka, Yokohama, all of (JP)

(73) Assignee: Kabushiki Kaisha Toshiba, Kawasaki (JP)

( * ) Notice: Subject to any disclaimer, the term of this patent is extended or adjusted under 35 U.S.C. 154(b) by 0 days.

(21) Appl. No.: 09/471,488

(22) Filed: Dec. 23, 1999

(30) Foreign Application Priority Data

Dec. 25, 1998 (JP) ..... 10-370033
Mar. 17, 1999 (JP) ..... 10-071639

(51) Int. Cl.[7] ..... G03G 15/10

(52) U.S. Cl. ..... 399/57; 399/58; 399/237; 399/249; 399/296

(58) Field of Search ..... 399/57, 58, 59, 399/233, 237, 249, 296, 318, 348, 390; 430/117, 119, 126

(56) References Cited

U.S. PATENT DOCUMENTS 4,181,094 * 1/1980 Gardiner ..... 399/249
4,482,242 * 11/1984 Moraw et al. ..... 399/249
5,089,856 * 2/1992 Landa et al. ..... 399/249
5,276,492 1/1994 Landa et al. .
5,493,369 * 2/1996 Sypula et al. ..... 399/249
5,570,173 10/1996 Nye et al. .
5,608,507 3/1997 Nguyen .
5,640,655 * 6/1997 Shoji ..... 399/249
5,723,251 * 3/1998 Moser ..... 430/126
5,920,756 * 7/1999 Matsuda et al. ..... 399/307
6,072,972 * 6/2000 Obu et al. ..... 399/237

* cited by examiner

*Primary Examiner*—Robert Beatty
*Assistant Examiner*—Hoang Ngo
(74) *Attorney, Agent, or Firm*—Oblon, Spivak, McClelland, Maier & Neustadt, P.C.

(57) ABSTRACT

Disclosed is image forming apparatus, including a photoconductor, a charger charging the surface of the photoconductor, a light source exposing the charged surface of the photoconductor to light to form a latent image, a developing unit supplying a liquid developing agent containing a liquid component and a solid component onto the photoconductor so as to convert the latent image into a visible image, a liquid component adjusting unit for adjusting the weight of the liquid component of the liquid developing agent on the surface of the photoconductor to meet the relationship of $0.1 \leqq Ml/Ms \leqq 4.0$, where Ms represents the weight of the solid component of the developing agent supplied onto the photoconductor, and Ml represents the weight of the Liquid component of the developing agent, and a transfer unit transferring the visible image onto an image carrier.

20 Claims, 3 Drawing Sheets

IMAGE FORMING APPARATUS AND IMAGE FORMING METHOD

BACKGROUND OF THE INVENTION

The present invention relates to an image forming apparatus, particularly, to an image forming apparatus using a liquid developing agent.

A wet image forming method using a liquid developing agent such as an electrophotographic recording method or an electrostatic recording method produces various merits that cannot be achieved by a dry image forming method and, thus, the wet image forming method is being reevaluated in recent years.

To be more specific, the wet image forming method is advantageous over the dry image forming method in that a high image quality can be achieved because it is possible to use very fine toners of a submicron order in the wet image forming method, that the wet image forming method is economical because a sufficiently high image density can be achieved with a small amount of the toner; that a texture fully comparable with that of a printing, e.g., offset printing, can be achieved with a small amount of the toner, and that the energy saving can be achieved because the toner can be fixed to a paper sheet at a relatively low temperature.

On the other hand, several essential problems remain unsolved in the conventional wet image forming method using a liquid toner, with the result that the dry image forming method has been employed substantially exclusively over a long period of time. One of the problems inherent in the wet image forming method resides in the transfer step.

The first problem in the transfer step is deterioration of the image quality. Specifically, in the conventional transfer step, the developing agent attached to the photoconductor is directly transferred onto a paper sheet under the action of an electric field. As a result, the developing agent was transferred nonuniformly onto the paper sheet in accordance with the fluctuation of the electric field conforming with the irregularity on the surface of the paper sheet. Also, a defective transfer of the developing agent tended to take place depending on the nonuniformity in the electrical characteristics of the paper sheet and also depending on the environment. Because of these problems, the quality of the transferred image was markedly deteriorated.

As a measure for solving these problems, proposed is a method in which a toner image is temporarily transferred from a photoconductor onto an intermediate transfer medium, followed by further transferring the toner image onto a paper sheet. To be more specific, a method of transferring a toner image from a photoconductor onto an intermediate transfer medium under the action of an electric field, followed by further transferring the toner image from the intermediate transfer medium onto a paper sheet under pressure (and heat), is disclosed in, for example, U.S. Pat. Nos. 5,148,222, 5,166,734 and 5,208,637.

Also, a method, in which a toner image transfer onto an intermediate transfer medium and onto a paper sheet is carried out under pressure (and heat) without employing a toner image transfer under an electric field, is disclosed in, for example, Japanese Patent Publication (Kokoku) No. 46-41679 and Japanese Patent Disclosure (Kokai) No. 62-280882. Since it is relatively easy for the intermediate transfer medium to be formed of a material having a smooth surface and low in nonuniformity and fluctuation in electrical resistance, the method disclosed in these prior arts makes it possible to drastically improve the deterioration in the image quality caused by the toner image transfer, compared with the case where the toner image is directly transferred onto a paper sheet under the action of an electric field.

Deterioration in the image quality can also be markedly suppressed in the case where the toner image is transferred onto the intermediate transfer medium under pressure and heat. Also, in these proposals in which the toner image is transferred onto the paper sheet under heat and pressure, it is possible to eliminate the problems observed in the toner image transfer under the action of an electric field such as a nonuniform transfer caused by fluctuation of the electric field depending on the irregularity on the surface of the paper sheet and a defective transfer depending on the nonuniformity of the electric characteristics of the paper sheet and on the environment.

However, practical problems remain unsolved in these proposals, as pointed out below. First of all, since the intermediate transfer medium is used, the image forming process is rendered complex. Also, the image quality is fluctuated in accordance with deterioration of the intermediate transfer medium. Since the intermediate transfer medium is generally required to exhibit a sufficient elasticity and satisfactory release characteristics, the intermediate transfer medium comprises in many cases an elastic layer made of, for example, rubber and a release layer consisting of a silicone-series resin or a fluorine-containing resin and formed on the surface of the elastic layer. Because of the particular construction, the intermediate transfer medium is inferior in durability to the other constituents of the apparatus.

Further, it is difficult to maintain 100% of the transfer efficiency in the step of transferring the toner image from the intermediate transfer medium onto the paper sheet, making it necessary to use a cleaner for removing the toner remaining on the intermediate transfer medium after transfer of the toner image onto the paper sheet. Use of the cleaner makes the image forming system more complex in construction. In addition, the durability of the intermediate transfer medium is further deteriorated by the damage done by the cleaner to the intermediate transfer medium.

As a measure for overcoming the above-noted problems inherent in the intermediate transfer medium, proposed is a method of directly transferring the toner image from the photoconductor onto the image carrier (paper sheet) under heat and pressure. For example, disclosed in U.S. Pat. No. 5,608,507 is a method of directly transferring an image of a liquid toner from a photoconductor having a release layer on the surface onto a paper sheet under heat and pressure.

In the invention disclosed in the U.S. Patent noted above, the liquid toner image attached to the latent image on the surface of a photosensitive body is dried out completely and, then, transferred onto the paper sheet. As a result, the solvent is not attached to the paper sheet, making it possible to suppress the release of a harmful solvent vapor to the outside of the image forming apparatus.

However, according to the experiment conducted by the present inventors in accordance with the method disclosed in the particular U.S. Patent, it has been clarified that the method disclosed in the U.S. Patent is accompanied by the following problems. First of all, it is very difficult to transfer the toner image, in which the solvent has been completely dried, onto a paper sheet under pressure (and heat). As described in detail in the U.S. Patent, in order to improve the transfer efficiency, it is necessary to form a photosensitive layer on an elastic lining layer so as to improve the bonding strength between the surface of the paper sheet and the toner by utilizing the elastic deformation of the photosensitive layer.

In this case, it has been found that the photosensitive layer is deformed repeatedly in accordance with deformation of the elastic body under pressure produced by the pressurizing member pushing the back surface of the paper sheet. As a result, a fatigue breakage takes place in the binder resin constituting the photosensitive body, leading to a marked shortening in the life of the photosensitive body. It should be noted in this connection that the photosensitive body is required to be flexible, making it impossible to use a metallic photosensitive body made of, for example, an amorphous silicon or selenium. In other words, it is necessary to use a photosensitive body containing a binder resin such as an organic photosensitive body. It follows that it is difficult to improve the life of the photosensitive body.

It should also be noted that, in order to obtain a good transfer efficiency, it is necessary for the surface layer of the photosensitive body to be formed of a material having markedly high release characteristics. In short, it is very difficult to meet both excellent photosensitive characteristics and high release characteristics. Further, in order to obtain a high transfer efficiency close to 100%, it is necessary to heat the photosensitive layer and the pressurizing member (back up roller) to a temperature not lower than 100° C. so as to melt the toner sufficiently and, at the same time, to push the paper sheet against the photosensitive body at a high pressure. Naturally, the photosensitive body is further deteriorated by the heating. Also, a large amount of energy is required and the required driving torque is increased.

As described above, if it is intended to obtain a good transfer efficiency in the conventional wet image forming method of a direct image transfer type utilizing heat (and pressure), the life of the photosensitive body is shortened and it is difficult to select the suitable material. In addition, a large heat energy is required, and the required driving torque is increased.

BRIEF SUMMARY OF THE INVENTION

An object of the present invention is to provide an image forming apparatus capable of continuing to realize good toner image transfer characteristics and a high quality image output.

Another object of the present invention is to provide an image forming method capable of continuing to realize good toner image transfer characteristics and a high quality image output.

According to a first aspect of the present invention, there is provided an image forming apparatus, comprising a photoconductor; a charger charging the surface of the photoconductor; a light source exposing the charged surface of the photoconductor to light to form a latent image; a developing unit supplying a liquid developing agent containing a liquid component and a solid component onto the photoconductor so as to convert the latent image into a visible image; a liquid component adjusting unit adjusting the weight of the liquid component of the liquid developing agent on the surface of the photoconductor to meet the relationship of $0.1 \leqq Ml/Ms \leqq 4.0$, where Ms represents the weight of the solid component of the developing agent supplied onto the photoconductor, and Ml represents the weight of the liquid component of the developing agent; and a transfer unit transferring the visible image onto an image carrier.

According to a second aspect of the present invention, there is provided an image forming method, comprising charging a surface of a photoconductor; exposing the charged surface of the photoconductor to light to form a latent image; supplying a liquid developing agent containing a liquid component and a solid component onto the photoconductor to convert the latent image into a visible image; adjusting the weight of the liquid component of the liquid developing agent on the surface of the photoconductor to meet the relationship of $0.1 \leqq Ml/Ms \leqq 4.0$, where Ms represents the weight of the solid component of the developing agent supplied onto the photoconductor, and Ml represents the weight of the liquid component of the developing agent; and bringing the visible image into contact under pressure with an image carrier to permit the visible image to be transferred onto the image carrier.

According to a third aspect of the present invention, there is provided an image forming apparatus, comprising a photoconductor; a charger charging the surface of the photoconductor; a light source exposing the charged surface of the photoconductor to light to form a latent image; a developing unit supplying a liquid developing agent containing a liquid component and a solid component onto the photoconductor so as to convert the latent image into a visible image; a transfer unit transferring the visible image onto an image carrier; and a resin imparting tool imparting a substantially transparent or slightly colored resin layer, which gives no substantial detrimental effect to the recognition of the visible image, to the visible image prior to transference of the visible image onto the image carrier performed by the transfer unit.

Further, according to a fourth aspect of the present invention, there is provided an image forming apparatus, comprising a photoconductor; a charger charging the surface of the photoconductor; a light source exposing the charged surface of the photoconductor to light to form a latent image; a developing unit supplying a liquid developing agent containing a liquid component and a solid component onto the photoconductor so as to convert the latent image into a visible image, the visible image being formed of a developing agent layer having a minimum thickness of 0.1 $\mu$m or more and a maximum thickness of 20 $\mu$m or less; and a transfer unit transferring the visible image onto an image carrier.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE INVENTION

Figure 1:
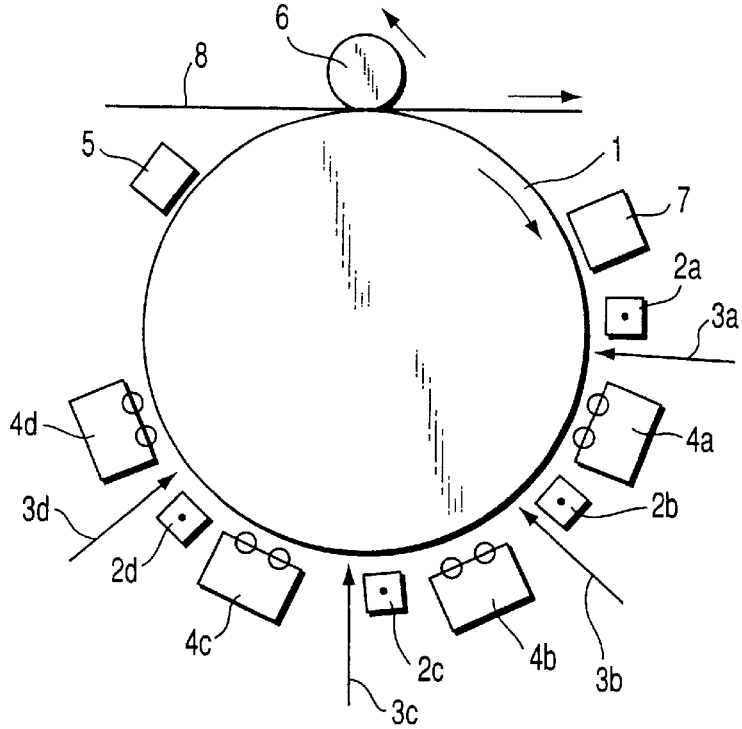
FIG. 1 is a cross sectional view exemplifying an image forming apparatus according to a first embodiment of the present invention.

The first aspect of the present invention is featured in that the weight of the liquid component of the liquid developing agent on the surface of the photoconductor is adjusted to meet the relationship of $0.1<Ml/Ms\leqq 4.0$, more preferably $0.3\leqq Ml/Ms\leqq 2.0$, where Ms represents the weight of the solid component of the developing agent supplied onto the photoconductor, and Ml represents the weight of the liquid component of the developing agent.

If the liquid component of the liquid developing agent is adjusted to meet the relationship given above, the adhesive force between the solid component of the developing agent and the image carrier is made larger than the adhesive force between the solid component and the photoconductor. As a result, the solid component of the developing agent on the surface of the photoconductor can be transferred onto the image carrier without utilizing an electric field.

In the first aspect of the present invention, traces of the liquid component are contained in the developing agent in the transferring step. As a result, the solid component that is swollen by the liquid component is attached to the photoconductor. Under this condition, the solid component is brought into contact under pressure with and tangled about the fibers of the image carrier such as a paper sheet. As a result, the adhesive force between the solid component and the image carrier is made larger than the adhesive force between the solid component and the photoconductor. It follows that the developing agent can be transferred under pressure onto the image carrier without applying an electric field.

Particularly, where the weight of the liquid component of the liquid developing agent is adjusted to meet the relationship of $0.1\leqq Ml/Ms\leqq 1.2$, where Ms represents the weight of the solid component, and Ml represents the weight of the liquid component of the developing agent, it is not absolutely necessary to apply pressure in the transferring step.

The second aspect of the present invention is featured in that a substantially transparent or slightly colored resin layer, which gives no substantial detrimental effect to the recognition of the visible image, is imparted to the visible image prior to transfer of the visible image. The resin layer can be imparted between the developing step and the transfer step. Alternatively, the resin layer can be imparted before the developing step.

The resin layer can be imparted to the image region alone of the visible image, or to the image region of the visible image and the region in the vicinity of the image region. Further, the resin layer can be imparted to both the image region of the visible image and the background region.

A direct transfer system in which the visible image having the resin layer imparted thereto is directly transferred onto the image carrier can be employed in the transfer unit. Alternatively, it is also possible to employ an indirect transfer system in which the visible image is transferred first onto an intermediate transfer medium, followed by further transferring the visible image from the intermediate transfer medium onto the image carrier.

The transfer unit serves to transfer under pressure or both pressure and heat the visible image having a resin layer imparted thereto onto the image carrier. In this case, the transfer unit comprises a pressurizing roller pressed against the photoconductor with the image carrier interposed therebetween, and a pressing means for pressing the pressurizing roller against the latent image carrier such that the load per unit length in the axial direction of the pressurizing roller falls within a range of between 0.3 kg/cm and 15 kg/cm.

It is desirable for the resin layer to be imparted to the visible image such that the resin layer has a thickness of 0.1 to 20 $\mu$m. Also, the resin layer can be imparted to the image carrier under the action of an electric field by using a coating solution containing a solid resin component and a solvent component. In this case, it is desirable for the coating solution to contain 1 to 40% by weight of the solid component.

Incidentally, it is desirable to heat the visible image having the resin layer imparted thereto to 30 to 150° C. by using a heating means. It is also desirable to adjust the amount of the solvent component by a squeezing means such that the solution contains 25 to 100% of solid components including the developing agent forming a visible image and the resin layer and 0 to 75% of the solvent component.

The third aspect of the present invention is featured in that the developing agent layer forming a visible image has a minimum thickness of 0.1 $\mu$m or more and a maximum thickness of 20 $\mu$m or less. In the third aspect of the present invention, the thickness of the developing agent layer forming a visible image can be controlled to fall within a range of between 8 $\mu$m and 20 $\mu$m.

According to the second and third aspects of the present invention constructed as described above, the thickness of the developing agent layer forming a visible image is set at a large value. Also, the apparent thickness of the developing agent layer is set at a large value by imparting a resin layer to the developing agent layer. As a result, good transfer characteristics and a high quality image output are kept ensured in the wet image formation.

Various embodiments of the present invention will now be described with reference to the accompanying drawings.

Specifically, FIG. 1 exemplifies a wet image forming apparatus according to the first aspect of the present invention. As shown in the drawing, the wet image forming apparatus of the present invention comprises a photoconductor 1, which is a photosensitive drum consisting of a cylindrical conductive base body and a photosensitive layer formed on the surface of the base body. The photosensitive layer is formed of an organic material, amorphous silicon, or the like. The photoconductor 1 is uniformly charged by a known corona charger or a scorotron charger 2*a*. Then, the charged surface of the photoconductor 1 is selectively exposed to an image-modulated laser beam 3*a*, with the result that an electrostatic latent image is formed on the photoconductor 1. Further, the electrostatic latent image is converted into a visible image by a developing unit 4*a* housing a liquid developing agent.

It is possible for the liquid developing agent or toner particles (solid component of the liquid developing agent) attached to the electrostatic latent image to be transferred directly to a transfer unit 6 so as to be transferred onto a paper sheet. In the embodiment shown in the drawing, however, a second electrostatic latent image is formed by a second charger 2*b* and a second laser beam 3*b* and, then, the second electrostatic latent image is converted into a second visible image by a second developing unit 4*b* housing a second developing agent having a color differing from that of the liquid developing agent housed in the first developing unit 4*a*.

As described above, visible images of two different colors are formed on the photoconductor 1 after the second development. Likewise, third and fourth series of charging.light exposure.development are performed by a third charger 2*c*, a third laser beam 3*c*, a third developing unit 4*c*, a fourth charger 2*d*, a fourth laser beam 3*d* and a fourth developing unit 4*d* to form a full color visible image (toner image) on the photoconductor 1.

The liquid component is partly removed by a solvent recovery unit 5 from the liquid developing agent forming the visible image so as to control a ratio of the solid component to the liquid component of the developing agent at a predetermined value.

The toner image formed on the photoconductor 1 is transferred directly onto a paper sheet 8 by a transfer roller 6. In the transferring step, a predetermined pressure is applied from the transfer roller 6 to the toner image. It should be noted that a heating source is arranged within, for example, the transfer roller 6 or the photoconductor drum 1. As a result, the toner image, which is pressurized by the transfer roller 6, is heated and, thus, the transfer capability of the toner image is improved.

The liquid developing agent comprises a liquid component such as a non-polar solvent and a solid component such as resin and a colorant dispersed in the liquid component.

In the conventional direct transfer of the toner image utilizing an electric field, the solid component dispersed in the liquid component is transferred onto the paper sheet by electrophoresis. Therefore, it was necessary for the visible image moved to the transfer position to contain a considerably large amount of a solvent, giving rise to the problem that a large amount of the solvent was attached to the paper sheet. Since electrophoresis is not required in the direct transfer of the toner image by pressure, it was thought desirable to dry completely the toner image before transfer of the toner image onto the paper sheet. However, the present inventors have arrived at a novel finding as follows as a result of an extensive research.

First of all, the present inventors have conducted a direct transfer of the toner image onto an ordinary paper sheet using as a parameter the amount of the solvent contained in the visible image formed on the surface of a photosensitive body so as to measure the transfer efficiency. The developing agent used consisted of a liquid component of Isopar L or Norpar 12 (each being a trade name of a petroleum series insulating solvent manufactured by Exon Inc.) and a solid component of colored resin particles dispersed in the liquid component. Several kinds of samples of resin particles having an average particle diameter of 0.6 to 3 $\mu$m were prepared by adding a coloring pigment and a charge controller to a thermosetting resin having a glass transition point of −50° C. to 60° C.

The photosensitive bodies used included a single layer type organic photosensitive body, a single layer type organic photosensitive body having a protective layer formed on the surface, and an amorphous silicon photosensitive body. A silicone rubber roller 30 cm long and having a heater arranged therein was used as the transfer roller. The apparatus was constructed to permit a load of 1 kg to 250 kg to be applied from the transfer roller to the photosensitive body with a paper sheet interposed therebetween. Further, it was possible to change the surface temperature from room temperature to 180° C.

As the paper sheet 8, P-50S (trade name of an ordinary copying paper sheet manufactured by Toshiba Corporation) was used as a standard paper sheet. Further, additional experiments were conducted in respect of the toner image transfer onto paper sheets differing from P-50S noted above in the surface smoothness, thickness, etc.

The amount of the liquid component of the developing agent forming the visible image was controlled by drying within the air atmosphere the developing agent after the developing treatment for a predetermined period of time. The drying time was set at several stages such as 1 minute, 2 minutes, 5 minutes and 10 minutes.

For calculating the amounts of the liquid component and the solid component contained in the developing agent forming the visible image, a solid development was performed on the entire surface of the photosensitive body in a maximum concentration. Then, the photosensitive body was held stationary and dried for a predetermined period of time, followed by wiping off the solid image within an area of 100 $cm^2$ on the photosensitive body by using a Wiper-S-200 (trade name of quim wipe manufactured by Clasia Inc.) whose weight had been measured in advance. The weight of the solid image thus wiped off was measured again so as to calculate the amounts of the liquid component and the solid component contained in the developing agent forming the visible image.

In this case, the difference in weight between the developing agent before the wiping and the developing agent after the wiping represents the total weight including the liquid component and the solid component, and the attached amount per unit area is represented by M ($mg/cm^2$). The value measured separately as follows under the same developing conditions was used as the weight of the solid component.

Specifically, a solid toner image was transferred onto the entire surface region of a PET film (i.e., a transparent resin sheet called transparency sheet or an OHP film) by a method of transfer by an electric field, followed by drying the solid toner image for about 10 minutes on a hot plate of 80° C. Then, the weight Ma of the sheet having the toner attached thereto was measured. Further, the solid component was wiped off by using the petroleum series solvent and heated again for 10 minutes on the hot plate of 80° C., followed by measuring again the weight Mb of the sheet. It is possible to calculate the weight Ms per unit area of the solid component of the toner by the formula given below, in which S represents the toner attaching area:

$$Ms=(Ma-Mb)/S[\mathrm{mg/cm^2}]$$

The value of Ms thus obtained is used for determining the solvent attaching amount Ml per unit area on the photosensitive body, as follows:

$$Ml=M-Ms$$

The solid image on the entire surface referred to previously represents the image obtained when a maximum concentration of development is performed over the entire surface of the photoconductor. In a full color image forming method in which toner images of a plurality of colors are transferred onto a paper sheet, the solid image on the entire surface represents the image in which the attaching amount of the solid component to the surface of the photoconductor becomes maximum.

The transfer efficiency was measured under the various drying conditions given above under the conditions that the total load of the back up roller was set at 50 kg, the temperature was set at 60° C., and the moving speed of the photosensitive body was set at 80 mm/sec. It has been found that a high transfer efficiency can be obtained when the a ratio Ml/Ms, where Ml represents the weight of the liquid component of the liquid developing agent, and Ms represents the weight of the solid component of the liquid developing agent, meets the condition:

$$0.1 \leqq Ml/Ms \leqq 4.0$$

particularly, when the ratio Ml/Ms meets the condition:

$$0.3 \leqq Ml/Ms \leqq 2.0$$

Where the ratio Ml/Ms falls within the range noted above, the developing agent is attached to the surface of the photosensitive body under the state that a thin liquid film of the solvent is formed around the solid component or at the boundary between the solid component and the surface of the photosensitive body. The liquid film thus formed brings about suitable release characteristics between the surface of the photosensitive body and the solid component of the toner so as to improve the transfer efficiency. On the other hand, the liquid component of the toner is absorbed on the surface of the paper sheet. As a result, the solid component under pressure is moved to reach the fibers of the paper sheet so as to be tangled about the fibers. It follows that the toner can be transferred onto the paper sheet at a high efficiency.

Where the surface of the photosensitive body is coated with a surface coating agent such as a silicone series material or a fluorine-based material to form a thin releasing layer, the release characteristics of the liquid film are increased so as to obtain a good transfer efficiency of at least 95% under the measuring conditions given above.

Where the amount of the solvent contained in the toner image is very small, the liquid film is not interposed practically between the solid component of the liquid developing agent and the surface of the photosensitive body under the pressure of the transfer. As a result, the adhesive force is increased between the resin particles constituting the main component of the solid component and the surface of the photosensitive body so as to lower the transfer efficiency. On the other hand, where a very large amount of the solvent is contained in the toner image, it is impossible for the paper sheet to absorb the solvent completely. As a result, a solvent layer is formed between the solid component and the paper sheet so as to prevent the solid component from being moved to reach directly the fibers on the surface of the paper sheet. It follows that the transfer efficiency onto the paper sheet is lowered.

The transfer efficiency is dependent not only on the Ml/Ms ratio of the toner image but also on the other conditions such as the pressure and temperature of the transfer roller. It has been found, however, that under the conditions that can be set in practice, i.e., under the pressure that does not give detrimental effect to the driving of the photosensitive drum and under the temperature that does not bring about deterioration in the electrostatic characteristics of the photosensitive body, a good toner image transfer can be achieved under the condition of $0.1 \leqq Ml/Ms \leqq 4.0$, more preferably under the condition of $0.3 \leqq Ml/Ms \leqq 2.0$.

The suitable range of the Ml/Ms ratio is also changed depending on the paper sheet used. However, if the toner image is assumed to be transferred onto the standard ordinary paper sheet used for a hard copy in an office, it is necessary to set the Ml/Ms ratio to fall within the range noted above.

Concerning the heating of the constituting members, it is desirable to heat at least one member selected from the group consisting of the photoconductor, the visible image, the image carrier and the pressurizing member. If the solid component is melted by the heating, the resin is tangled about the fibers of the paper sheet so as to increase the adhesive force and, thus, to improve the transfer efficiency. In the heating step, it is desirable to control the heating temperature to fall within a range of between 40° C. and 150° C. If the heating temperature is lower than 40° C., the solid component is not melted sufficiently. On the other hand, if the heating temperature exceeds 150° C., the photosensitive body is deteriorated.

Figure 5:
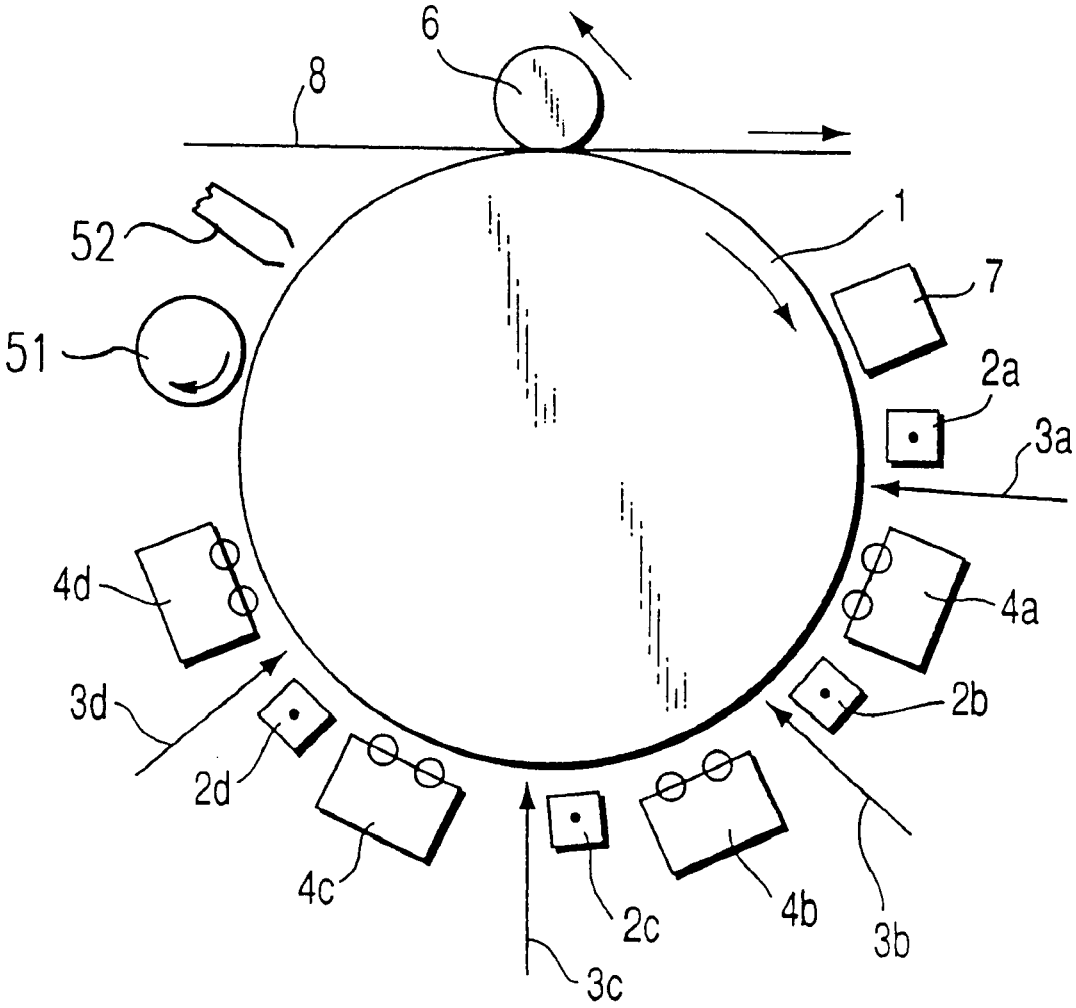
FIG. 5 is a cross-sectional view showing an image forming apparatus according to the invention.

The amount of the liquid component of the toner image can be adjusted by a liquid removing member arranged in the vicinity of or in contact with the photoconductor. For example, as shown in FIG. 5, a metallic roller 51 of a high processing accuracy is arranged to face the latent image holder 1 with a clearance of about 10 to 200 $\mu$m, preferably 20 to 100 $\mu$m, provided therebetween, and the metallic roller 51 is moved at a predetermined speed in a direction opposite to the moving direction of the latent image so as to remove a required amount of the liquid component. Also, a larger amount of the liquid component can be removed, if the side surface of an elastic roller or an elastic blade having release characteristics imparted to the surface thereof is brought into contact with the surface of the photoconductor. Further, as shown in FIG. 5, it is also possible to arrange an air nozzle 52 in the vicinity of the photoconductor 1 so as to permit the air nozzle 52 to blow the air to dry the liquid component or to suck the liquid component of the toner image. Of course, it is also possible to employ a plurality of these liquid removing means in combination. For example, the liquid component can be removed by the non-contact roller immediately after the development, followed by removing the residual liquid component by the air nozzle before the toner image transfer. In this case, the amount of the liquid component can be decreased to a desired level without fail even if the process speed is increased.

It is possible to use as the photoconductor various electrophotographic photosensitive bodies and dielectric bodies for electrostatic recording such as photoconductors used in the known ion flow system and in the multi-stylus system. However, in view of the situation that a relatively high pressure is applied to the photoconductor via a paper sheet and that heat is applied in the toner image transfer step, it is desirable to use an amorphous silicon series photosensitive body and an organic photosensitive body using a binder resin having a high durability. It should be noted in particular that the amorphous silicon photosensitive body exhibits an excellent mechanical durability. In addition, the photosensitive layer is heated in many cases. It follows that the amorphous silicon photosensitive body is most adapted for use in the toner image transfer method of the present invention.

It is not absolutely necessary to apply pressure in the transfer step if the ratio Ml/Ms, where Ml represents the weight of the liquid component and Ms represents the weight of the solid component of the developing agent forming the visible image, meets the condition given below:

$$0.1 \leqq Ml/Ms \leqq 1.2$$

Where the Ml/Ms ratio falls within the range given above, it is possible for the solid component to be brought into contact with the fibers of the paper sheet in respect of any kind of the paper sheet, making it possible to obtain a chance of the toner transfer even if a heavy load is not applied to the developing agent. If the paper sheet is simply brought into contact with the toner image, the solvent is partly absorbed by the paper sheet to permit the solid component to be brought into contact with the fibers of the paper sheet. It follows that a practically sufficient transfer efficiency can be obtained in the presence of an auxiliary function of the electric field or heat. In order to obtain the Ml/Ms ratio falling within the range noted above, it is desirable to use the contact type solvent removing member or the solvent removal by the air nozzle referred to previously.

As described above, the first aspect of the present invention provides an image forming method that permits transferring a visible image consisting of a liquid developing agent from a photoconductor directly to an image carrier at a high efficiency. It follows that it is possible to obtain an image forming method that permits realizing an image forming apparatus simple in construction, small in size, low in manufacturing cost, high in reliability and capable of improving the image quality.

Figure 2:
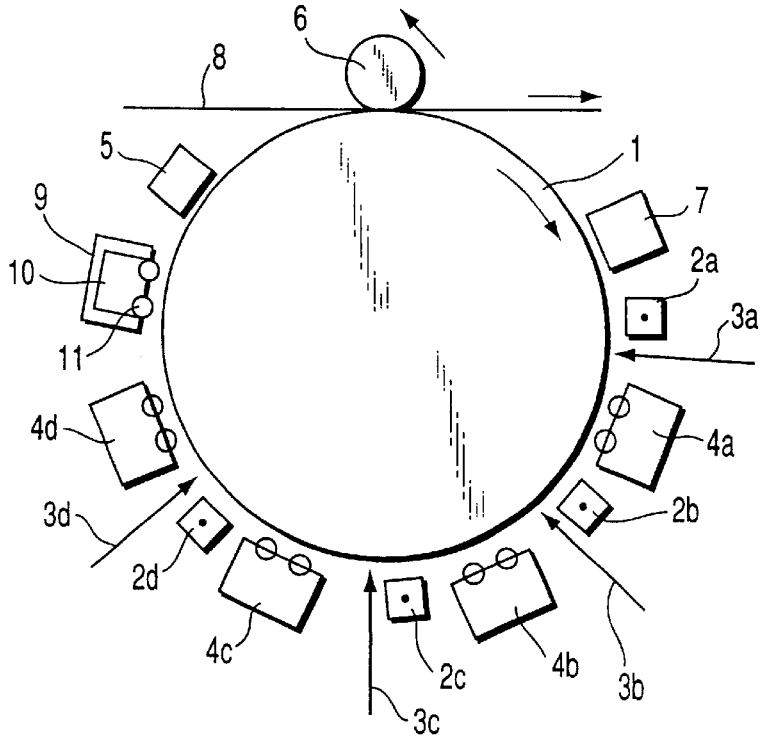
FIG. 2 is a cross sectional view exemplifying an image forming apparatus according to a second embodiment of the present invention.

A second aspect of the present invention will now be described. Specifically, FIG. 2 exemplifies a wet image forming apparatus according to the second aspect of the present invention. The wet image forming apparatus shown in FIG. 2 is substantially equal to that shown in FIG. 1, except that a resin imparting unit 9 is arranged in the apparatus shown in FIG. 2 between the fourth developing unit 4d and the solvent recovery unit 5.

In the conventional wet image forming apparatus, the thickness of the toner image formed on the surface of the photoconductor 1 within the developing unit is only about 0.4 $\mu$m. In the image region of a low concentration, it is not rare that the thickness of the toner image is not larger than 0.1 $\mu$m. Therefore, when a toner image is transferred onto an ordinary paper sheet having a surface irregularity of scores of microns, how to bring the toner particles into contact with the surface of the paper sheet is a serious problem to be solved.

Also, in the conventional toner image transfer by utilizing an electric field, the solvent is also allowed to permeate the concave portions of the paper sheet so as to permit the toner particles to be attached (transferred) into the concave portions of the paper sheet by electrophoresis. As a result, the paper sheet absorbing a large amount of the solvent is discharged to the outside of the image forming apparatus so as to bring about an air pollution problem caused by evaporation of the solvent.

In the toner image transfer under pressure (or heat), the solvent is sufficiently removed in advance and, then, the toner particles are transferred onto the paper sheet. In this case, however, it is necessary to attach a very thin toner layer having a thickness of about 0.1 $\mu$m to the concave portion having a depth of scores of microns on the surface of the paper sheet, as described previously. Therefore, it was absolutely necessary to use an elastic body for forming the photoconductor or an intermediate transfer medium such that the elastic body is deformed under a high pressure so as to bring the toner particles into contact with the concave portion on the surface of the paper sheet. This requirement brings about problems relating to the durability and stability of the photoconductor or the intermediate transfer medium, as already pointed out.

As a result of an extensive research conducted in an attempt to overcome the problems noted above, the present inventors have found that, even in the wet image forming process, the toner image can be transferred satisfactorily onto an ordinary paper sheet even if the surface of the photoconductor or the intermediate transfer medium is formed of a rigid material or a material low in flexibility, provided that the thickness of the toner image transferred onto the paper sheet falls within a range of between 0.3 $\mu$m and 20 $\mu$m, preferably between 1 $\mu$m and 10 $\mu$m.

An example of the wet image forming apparatus according to the second aspect of the present invention will now be described in detail with reference to FIG. 2. As already described, a transparent resin layer is imparted by the resin imparting unit 9 to the color image formed on the photoconductor 1 through the four color image forming process. Housed in the resin imparting device 9 is a so-called "transparent developing agent" 10 prepared by removing the coloring agent from the liquid developing agents housed in the developing units 4*a* to 4*d,* or consisting of the solvent and the solid component of the composition close thereto.

Of course, it is not necessary for the composition of the transparent developing agent to be equal to the composition of the colored developing agent. However, the transparent developing agent should desirably be close to the colored developing agent in the charging characteristics, the viscoelastic properties of the resin component, etc. The specific composition of the transparent developing agent comprises, for example, a liquid component of an insulating solvent such as Isopar G, L, M and Norpar 12 (trade names of insulating solvents manufactured by Exon Inc.), acrylic resins having a glass transition point of −50° C. to 50° C. as a solid component, and a metal soap acting as a charge controller.

In the image forming apparatus shown in FIG. 2, a transparent resin is imparted to the toner image by using such a transparent developing agent under the action of an electric field. For example, a resin imparting roller 11 having an outer diameter of 30 mm and made of a metal is arranged 150 $\mu$m apart from the photoconductor 1 and rotated in a direction equal or opposite to the rotating direction of the photoconductor so as to supply the transparent developing agent 10 to the toner image.

Where an inverted development is performed in the developing units 4*a* to 4*d* under a charging potential of 700V and a potential in the light exposed portion of 100V using a positive charging type photosensitive body as the photoconductor 1, a transparent resin layer can be imparted to the toner image by allowing the transparent resin attaching means to apply a voltage of 300V to 1500V, preferably 500V to 1000V, because the potential of the toner image formed on the photoconductor 1 is generally not higher than 200V.

Figure 3A:
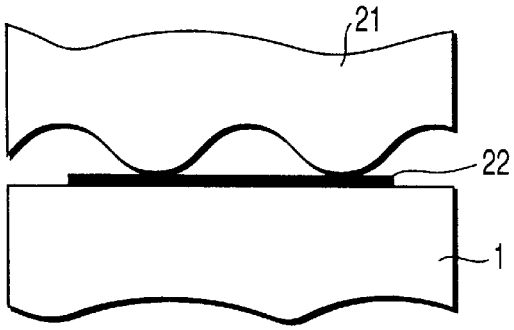
FIGS. 3A and 3B are cross sectional views schematically showing how a toner image is transferred in the image forming apparatus according to the second embodiment of the present invention and in the conventional image forming apparatus.
Figure 3B:
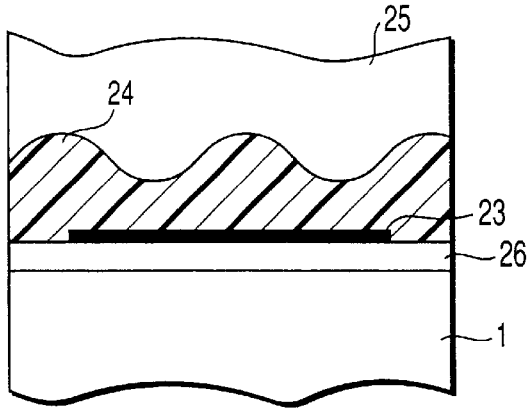

FIG. 3A is a cross sectional view schematically showing the case where a toner layer (image) 22 alone is transferred onto an ordinary paper sheet 21. On the other hand, FIG. 3B is a cross sectional view schematically showing the case where a transparent resin layer 24 is imparted before transfer of the toner layer 23, followed by transferring the toner layer 23 onto the transparent resin layer 24. In the examples shown in FIGS. 3A and 3B, a greater portion of the solvent component is removed from the visible image formed by a liquid development by using the known solvent recovery unit 5 (e.g., an inverted draw roller, an elastic contact roller, or an air knife) or a drying means such as a hot roller so as to perform the image transfer while scarcely wetting the paper sheet. In this system, the image transfer is performed by utilizing pressure (and heat) without utilizing the function of an electric field.

The thickness of the toner layer formed on the photoconductor by the liquid development is not larger than 0.5 $\mu$m in general, which is very small compared with the use of a dry toner. The toner particle diameter of the liquid developing agent is generally on the submicron order, i.e., not larger than 1/10 of the particle diameter of the dry toner. In addition, a large amount of a coloring component is contained in the color particles. As a result, a sufficient optical concentration can be obtained, though the toner layer is very thin.

Under the circumstances, it is very difficult to bring the toner layer 22 shown in FIG. 3A into a physical contact with the concave portion of the ordinary paper sheet 21 in transferring the toner layer 22 onto the ordinary paper sheet 21 having a surface irregularity of about 10 to 50 μm, making it very difficult to obtain a good transfer efficiency.

On the other hand, where the transparent resin layer 24 is imparted to the toner layer 23 as shown in FIG. 3B, the transparent resin layer 24 is deformed along the irregularity on the surface of the ordinary paper sheet 25 so as to be brought into contact with the concave portion of the ordinary paper sheet 25. As a result, the toner layer 23 can be transferred satisfactorily onto the ordinary paper sheet 25. It is desirable for the thickness of the transparent resin layer 24 to be larger than the surface irregularity of the paper sheet. However, even if the thickness of the transparent resin layer is smaller than the surface irregularity of the paper sheet, the paper sheet is strongly pressed against the surface of the photoconductor 1 by the pressing of the pressurizing roller 6 so as to elastically deform the paper sheet. As a result, the surface roughness of the paper sheet is temporarily lowered in the image transfer position, making it possible to obtain a good image transfer.

In the case of using a paper sheet having a small surface roughness such as a coated paper sheet, it is of course possible to achieve a good transfer of the toner image even if the transparent resin layer is made thinner. Also, where the toner layer is transferred together with the transparent resin layer onto the paper sheet, it is necessary for the adhesive force between the transparent resin layer and the toner layer to be larger than the adhesive force between the toner layer and the surface of the photoconductor. Therefore, it is desirable to form a release layer 26 in practice on the surface of the photoconductor so as to improve the releasing properties of the toner layer. It is also desirable to use a transparent resin having a large adhesive force to the toner. Further, it is more desirable to use a transparent resin having a composition equal or close to that of the resin forming the toner.

It should be noted that the transparent resin used in the present invention represents a resin having a small optical absorption in the wavelength region of the visible light to allow the human eye to recognize the resin as a substantially transparent resin. It is acceptable for the transparent resin used in the present invention to have an optical absorption in the infrared region or the ultraviolet region.

Figure 4:
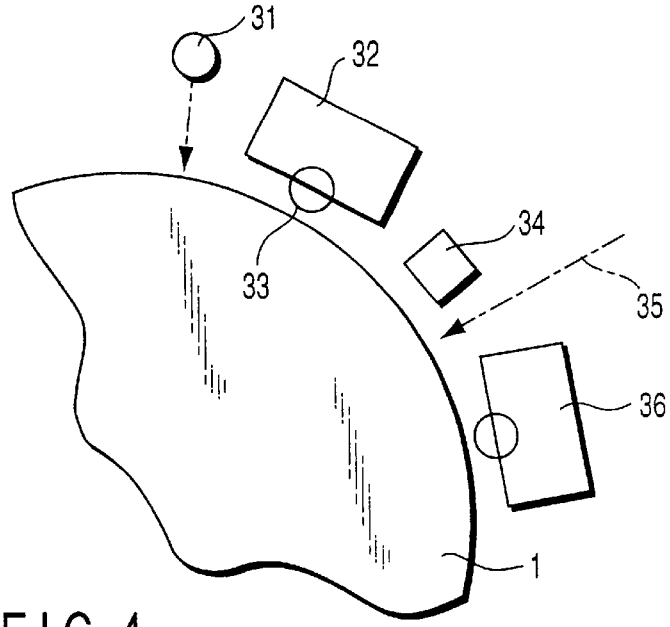
FIG. 4 is a cross sectional view showing a gist portion of another example of the image forming apparatus according to the second embodiment of the present invention.

As described above, in the second aspect of the present invention, a transparent resin is imparted after formation of a toner image on the photoconductor. Alternatively, a transparent resin may be imparted before formation of the toner image, as shown in FIG. 4. In the example shown in FIG. 4, a transparent resin is imparted to the surface of the photoconductor by a resin imparting roller 33 before the photoconductor 1 is moved to reach the position of a corona charger 34, followed by exposure to a beam 35 and, then, development by a developing unit 36 so as to form a toner image on the transparent resin. The expression that a resin layer is imparted to a visible image comprises such a construction, too.

The transparent resin may be imparted to only the position of the toner image, i.e., to only the image region. Also, the transparent resin may be imparted to both the background region and the image region, i.e., to the entire surface of the photoconductor. Where the transparent resin is imparted to the entire region of the photoconductor, the entire surface is developed by using a transparent developing agent with the nonuniformity in space of the latent image potential kept diminished.

For example, in the construction shown in FIG. 4, the surface potential of the photoconductor is made uniform by a destaticizing lamp 31. Specifically, the surface potential is set at about 20V by the destaticizing lamp 31. Then, a voltage of 500V to 1000V is applied to the resin imparting roller 33 so as to permit the positively charged transparent resin particles to be uniformly attached to the surface of the photoconductor by the principle equal to that in the ordinary liquid development. Further, the photoconductor 1 is charged to 500V to 800V through the transparent resin layer by the corona charger 34, followed by light exposure by the light exposure means 35 so as to form a latent image. If the thickness of the transparent resin layer falls within a range of between 0.1 μm and 5 μm, the latent image formation is not adversely affected and the toner image transfer onto a paper sheet can be improved.

If the latent image is developed by the developing unit 36, a toner image is formed on the transparent resin layer. The toner image thus formed can be transferred directly onto a paper sheet. Alternatively, additional developments can be repeated as shown in FIG. 2 and, then, the toner image is transferred onto the paper sheet. If the toner image thus formed is transferred together with the transparent resin layer directly onto a paper sheet, the transparent resin layer is positioned on the outermost surface of the transferred toner image. As a result, the transparent resin layer produces a laminate effect so as to obtain a lustrous toner image of a high quality as if a finishing treatment is applied to the toner image.

The particular effect can also be obtained in the case where a transparent resin layer is attached to the entire surface of the photoconductor after the developing treatment as shown in FIG. 2. It should also be noted that, in this case, a latent image is not formed after attachment of the transparent resin layer, making it possible to further increase the thickness of the transparent resin layer. It follows that the toner image transfer capability can be markedly improved.

It is desirable for the thickness of the transparent resin layer to fall within a range of between 0.1 μm and 20 μm. If the transparent resin layer is thicker than 20 μm, the toner image is collapsed when transferred onto a paper sheet. Also, the flexibility of the paper sheet is impaired after transfer of the toner image. In addition, the printing cost is increased. The thickness of the transparent resin layer can be increased by various methods. For example, the thickness of the transparent resin layer can be increased by intensifying the electric field, by increasing the rotating speed of the resin imparting roller, by increasing the diameter of the resin imparting roller, by increasing the particle diameter of the transparent resin, by lowering the charging amount of the transparent resin, by increasing the contact time between the transparent developing agent and the photoconductor by filling a dish-like container with the transparent developing agent and dipping the photoconductor in the transparent developing agent, and by increasing a ratio of the transparent resin particle component in the transparent developing agent.

Among the various methods exemplified above, it is particularly effective to increase a ratio of the transparent resin particle component in the transparent developing agent. To be more specific, where the solid component is contained in the transparent developing agent in an amount of 1 to 40% by weight, preferably 2 to 10% by weight, it is possible to obtain a transparent resin layer having a thickness large enough to perform the toner image transfer and small enough to prevent the toner image from being collapsed.

It is desirable for the solvent content per unit volume of the developing agent and the transparent developing agent attached to the surface of the photosensitive body to fall within a range of between 0 g/cm$^3$ and 4 g/cm$^3$.

In the examples shown in FIGS. 2 to 4, the transparent resin is imparted by the principle equal to that of the liquid development. However, other coating techniques can also be employed. For example, it is possible to use a coating apparatus using a brush roller, a coating apparatus in which the transparent resin is carried by a foamed body such an elastic foam, an apparatus in which a transparent paint containing a high concentration of a solid component is carried by a roller for imparting the solid component, and a spray coating apparatus. In the case of employing any of these means, it is not absolutely necessary to impart in advance an electric charge to the solid component.

It should also be noted that the consumption of the transparent resin can be decreased by imparting a transparent resin layer to that portion alone to which the toner is attached so as to lower the printing cost.

Where the transparent resin is imparted before the developing step, an electrostatic latent image corresponding to the output image is formed, and a resin layer is imparted to the latent image thus formed by the principle of the liquid development. Where a color output image is formed by the process shown in FIG. 2, it is necessary to form a latent image by using the data of the final image having color-decomposed images superposed thereon. After a resin layer is formed in this fashion as in the process shown in FIG. 4, a toner development is performed on the resin layer.

It is possible to apply the method of forming an electrostatic latent image on the position of the toner image by the charging and light exposure as described above, even in the case where a resin layer is imparted to the toner-attached portion after the development. In this case, however, the apparatus can be simplified by employing the method described below.

Specifically, the surface of the photoconductor is uniformly charged temporarily in the first step by, for example, a corona charger, followed by applying a light exposure to the entire surface. If the light exposure to the entire surface is performed by using light having a wavelength region sensitive to the photosensitive body and absorbed by the toner image, the electric charge is not attenuated in the toner-attached portion and is attenuated in the portion where the toner is not attached. Therefore, if the development is performed by using a transparent developing agent containing transparent resin particles charged in a polarity opposite to the charged polarity in the toner-attached portion, it is possible to impart the transparent resin to only the toner-attached portion.

In this case, it is unnecessary to perform the light exposure to the image portion for imparting a resin layer, making it possible to realize a simple resin imparting means that does not require the optical system for the light exposure, the image processing circuit and the positioning mechanism for performing the light exposure onto the toner image without fail. The typical potential conditions include, for example, +300V to +800V for the toner-attached portion, 0V to +200V for the portion where the toner is not attached, and the transparent development bias of +300 to +600V for the voltage between these two potentials.

It is also effective to form an opening in the shield case of the corona charger for applying the light exposure to the entire surface, i.e., the method of performing the light exposure simultaneously with the charging. In this case, the process can be further simplified.

In a single color image forming process in which the development is performed only once, a transparent developing agent can be applied to the image portion alone by performing the development with the transparent developing agent, because the potential in the light-exposed portion is elevated by the toner attachment by scores of V in the ordinary liquid development, with the result that the electrostatic latent image is retained even after the development.

The effect produced by imparting the transparent resin is rendered most prominent in the case where the visible image is transferred in the transfer unit directly onto the image carrier (paper sheet) under pressure (and heat). However, even in an apparatus in which the visible image is transferred directly onto the paper sheet under the action of an electric field, the transparent resin layer flexibly enters the concave portion on the surface of the paper sheet. As a result, an excessively large amount of the solvent is not attached to the paper sheet so as to obtain an image transfer at a high efficiency.

Of course, in the case where the visible image having a transparent resin imparted thereto is once transferred onto an intermediate transfer medium, followed by further transferring the visible image onto the image carrier, the transfer characteristics from the intermediate transfer medium onto the paper sheet are improved by the attachment of the transparent resin.

The transfer characteristics can be further improved by forming a release layer made of a silicone series material or a fluorine-containing material on the surface of the photoconductor. Particularly, where a transparent resin layer is imparted to the entire surface of the photoconductor, the release layer is important because it is necessary to markedly decrease the total adhesive force between the resin layer and the photoconductor so as to improve the release properties of the paper sheet.

It is important for the transparent resin to be capable of being deformed in conformity with the surface shape of the paper sheet in the transfer position so as to be brought into contact with the concave portion on the surface of the paper sheet. Such being the situation, it is important to heat the visible image and the transparent resin layer to temperatures falling within a range of between 30° C. and 150° C. so as to soften the resin. However, an excessive heating is not desirable in view of the energy saving.

It should also be noted that, if the visible image and the transparent resin are moved to reach the transfer position under the condition that the solvent component is contained in an amount of 3 to 50% based on the total amount of the visible image and the transparent resin, a desired flexibility can be obtained simultaneously with the heating by the swelling function performed by the solvent. Naturally, it is effective to arrange a drawing means for controlling the solvent amount to fall within the range noted above. If the amount of the solvent component is excessively small, a flexibility is lost. On the other hand, if the amount of the solvent component is excessively large, an air pollution problem is likely to be generated.

Further, in order to obtain a satisfactory image transfer, it is desirable for the transfer unit to comprise a pressurizing roller pressed against the photoconductor with the image carrier interposed therebetween and a means for pushing the pressurizing roller against the photoconductor such that the load per unit length in the axial direction of the pressurizing roller falls within a range of between 0.3 kg/cm and 15 kg/cm. If the load is smaller than the lower limit of this range, the transfer efficiency is lowered. On the other hand, if the load is larger than the upper limit of the above-noted range, problems are generated such that the paper sheet is wrinkled and that the driving torque of, for example, the pressurizing roller is rendered excessively large.

A transparent resin is used in the second aspect of the present invention described above. However, it is not absolutely for the resin to be transparent. In other words, it is possible to use a colored resin as far as the color of the resin does not give a detrimental effect to the recognition of the toner image, or the detrimental effect is small such that the recognition of the toner image is not rendered difficult. For example, it is possible to use a resin of the color equal to that of the paper sheet. Where the paper sheet is white, the particular effect of the present invention can be obtained without giving any detrimental effect to the toner image by coloring the resin white.

In the second aspect of the present invention described above, the thickness of the toner layer is increased by using a resin so as to improve the transfer characteristics. However, a similar effect can be obtained without imparting a resin layer as far as the thickness of the toner image itself can be increased. According to the experiment conducted by the present inventors, a good transfer efficiency can be obtained by the direct pressure transfer or the indirect pressure transfer, if the thickness of the toner image is controlled to fall within a range of between 0.1 $\mu$m and 20 $\mu$m. Particularly, where the thickness of the toner image falls within a range of between 8 $\mu$m and 20 $\mu$m, the transfer efficiency can be prominently improved.

In order to obtain a toner image of the desired thickness, it is effective to increase a ratio of the solid component in the liquid developing agent to fall within a range of between, for example, 3% by weight and 30% by weight. It is also possible to employ the method of increasing the particle diameter of the toner, the method of intensifying the developing electric field, the method of increasing the rotating speed of the developing roller, and the method of increasing the contact time between the developing solution and the photoconductor.

In any of the methods exemplified above, it is important to set the thickness of the toner layer at a level not smaller than 0.1 $\mu$m in the highlight portion (low concentration portion) of the image. It is also possible to lower a ratio of the colorant component in the toner particles to fall within a range of, for example, between 1% by weight and 15% by weight so as to obtain a desired optical concentration even if a large amount of toner is attached.

As described above, in the second aspect of the present invention, the apparent thickness of the developing agent layer is increased by imparting a resin layer, making it possible to transfer a visible image consisting of the liquid developing agent onto an image carrier at a high efficiency and to decrease the amount of the solvent attached to the paper sheet. It follows that it is possible to obtain an image forming apparatus capable of forming a high quality image and capable of suppressing the air pollution problem. Incidentally, the similar effects can also be obtained by increasing the thickness of the developing agent layer constituting the visible image.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. An image forming apparatus, comprising:

a photoconductor having a surface;

a charger configured to charge the surface of the photoconductor;

a light source configured to expose the charged surface of the photoconductor to light to form a latent image;

a developing unit configured to supply a liquid developing agent containing a liquid component and a solid component onto the photoconductor to convert the latent image into a visible image;

a liquid component adjusting unit configured to adjust the weight of the liquid component of the liquid developing agent on the surface of the photoconductor to meet the relationship of $0.1 \leqq Ml/Ms \leqq 4.0$, where Ms represents the weight of the solid component of the developing agent supplied onto the photoconductor, and M1 represents the weight of the liquid component of the developing agent; and a transfer unit configured to transfer the visible image onto an image carrier by utilizing pressure.

2. An image forming apparatus according to claim 1, wherein the liquid component adjusting unit adjusts the liquid component to meet the relationship:

$$0.1 \leqq Ml/Ms \leqq 1.2.$$

3. An image forming apparatus according to claim 1, further comprising a heater heating at least one member selected from the group consisting of the photoconductor, the visible image, and image carrier and the transfer unit.

4. An image forming apparatus according to claim 1, wherein the liquid component adjusting unit is a roller arranged to face the photoconductor and having a moving surface in a direction opposite to a moving direction of the surface of the photoconductor at a position facing the photoconductor.

5. An image forming apparatus according to claim 1, wherein the liquid component adjusting unit is an elastic roller or an elastic blade arranged to face the photoconductor in direct contact with the photoconductor.

6. An image forming apparatus according to claim 1, wherein the liquid component adjusting unit is an air nozzle blowing the air against or sucking the air from the photoconductor.

7. An image forming apparatus according to claim 1, wherein a weight ratio of the liquid component of the liquid developing agent to the solid component of the liquid developing agent is a value determined under the condition that the solid image of a maximum concentration formed on the photoconductor is converted into a visible image.

8. An image forming method, comprising:

charging a surface of a photoconductor;

exposing the charged surface of the photoconductor to light to form a latent image;

supplying a liquid developing agent containing a liquid component and a solid component onto the photoconductor to convert the latent image into a visible image;

adjusting the weight of the liquid component of the liquid developing agent on the surface of the photoconductor to meet the relationship of $0.1 \leqq Ml/Ms \leqq 4.0$, where Ms represents the weight of the solid component of the developing agent supplied onto the photoconductor, and Ml represents the weight of the liquid component of the developing agent; and bringing the visible image into contact under pressure with an image carrier to permit the visible image to be transferred onto the image carrier.

9. An image forming method according to claim 8, wherein the solid component is brought into contact with an image carrier under the condition that the solid component is attached to the photoconductor.

10. An image forming method according to claim 8, wherein a weight ratio of the liquid component of the liquid developing agent to the solid component of the liquid developing agent is a ratio under the condition that the solid image in a maximum concentration is converted into a visible image on the photoconductor.

11. An image forming apparatus, comprising:

a photoconductor having a surface;

a charger configured to charge the surface of the photoconductor;

a light source configured to expose the charged surface of the photoconductor to light to form a latent image;

a developing unit configured to supply a liquid developing agent containing a liquid component and a solid component onto the photoconductor to convert the latent image into a visible image;

a transfer unit configured to transfer the visible image onto an image carrier; and a resin imparting tool configured to impart a substantially transparent or slightly colored resin layer, which gives no substantial detrimental effect to the recognition of the visible image, to the visible image prior to transference of the visible image onto the image carrier performed by the transfer unit.

12. An image forming apparatus according to claim 11, wherein the resin layer is imparted to only the image region of the visible image or to only the image region of the visible image and the region in the vicinity thereof.

13. An image forming apparatus according to claim 11, wherein the transparent resin layer is imparted to the image region of the visible image and to the background region.

14. An image forming apparatus according to claim 11, wherein the transfer unit serves to transfer the visible image having the resin layer imparted thereto directly onto the image carrier.

15. An image forming apparatus according to claim 11, wherein the transfer unit serves to transfer the visible image having the resin layer imparted thereto onto the image carrier by utilizing pressure.

16. An image forming apparatus according to claim 11, wherein the resin layer is imparted in a thickness of 0.1 to 20 $\mu$m to the visible image.

17. An image forming apparatus according to claim 11, wherein the resin layer contains a solvent and a solid component dispersed in the solvent, and the resin layer is formed by coating a coating solution containing 1 to 40% by weight of the solid component.

18. An image forming apparatus, comprising:

a photoconductor having a surface;

a charger configured to charge the surface of the photoconductor;

a light source configured to expose the charged surface of the photoconductor to light to form a latent image;

a developing unit configured to supply a liquid developing agent containing a liquid component and a solid component onto the photoconductor to convert the latent image into a visible image, the visible image being formed of a developing agent layer having a minimum thickness of 8 $\mu$m or more and a maximum thickness of 20 $\mu$m or less; and a transfer unit configured to transfer the visible image onto an image carrier.

19. An image forming apparatus according to claim 18, wherein the transfer unit is configured to transfer the visible image onto the image carrier by utilizing pressure.

20. An image forming apparatus according to claim 1, wherein the liquid component adjusting unit adjusts the liquid component to meet the relationship:

$$0.3 \leqq Ml/Ms \leqq 2.0.$$

* * * * *

UNITED STATES PATENT AND TRADEMARK OFFICE

CERTIFICATE OF CORRECTION

PATENT NO. : 6,314,253 B1
DATED : November 6, 2001
INVENTOR(S) : Hosoya et al.

It is certified that error appears in the above-identified patent and that said Letters Patent is hereby corrected as shown below:

Title page,
Item [54], Title of Invention should read:
-- [54] IMAGE FORMING APPARATUS AND IMAGE FORMING METHOD USING A LIQUID DEVELOPING AGENT --
Item [30], Foreign Application Priority Data, should read:
-- [30] Foreign Application Priority Data
Dec. 25, 1998 (JP) ..... 10-370033
Mar. 17, 1999 (JP) ..... 11-071639 --

Signed and Sealed this

Sixteenth Day of July, 2002

*Attest:*

*Attesting Officer*

JAMES E. ROGAN
*Director of the United States Patent and Trademark Office*